US008658950B2

(12) United States Patent
Cho et al.

(10) Patent No.: US 8,658,950 B2
(45) Date of Patent: Feb. 25, 2014

(54) HEATING DEVICE CAPABLE OF ELIMINATING NOISE AND ADJUSTING DESIRED HEAT QUALITY OR HEATING TEMPERATURE BY CONTROLLING FREQUENCY DIFFERENCE BETWEEN TWO INDUCTION COILS DURING A FIRST TIME INTERVAL AND DISABLING ONE OF TWO INDUCTION COILS DURING A SECOND TIME INTERVAL

(75) Inventors: Cheng-Hsien Cho, Taoyuan Hsien (TW); Yin-Yuan Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 331 days.

(21) Appl. No.: 12/725,707

(22) Filed: Mar. 17, 2010

(65) Prior Publication Data

US 2010/0237065 A1 Sep. 23, 2010

(30) Foreign Application Priority Data

Mar. 18, 2009 (TW) ..... 98108822 A

(51) Int. Cl.
*H05B 6/12* (2006.01)

(52) U.S. Cl.
USPC ..... 219/626; 219/620; 219/624

(58) Field of Classification Search
USPC ..... 219/452.11, 623, 620, 624, 669, 626
See application file for complete search history.

(56) References Cited

U.S. PATENT DOCUMENTS

| | | | | |
|---|---|---|---|---|
| 5,714,739 | A * | 2/1998 | Irrera et al. | 219/626 |
| 6,064,584 | A * | 5/2000 | Cornec et al. | 363/95 |
| 6,528,770 | B1 * | 3/2003 | Akel et al. | 219/624 |
| 7,910,865 | B2 * | 3/2011 | Haag et al. | 219/620 |
| 2002/0117497 | A1 * | 8/2002 | Bassill et al. | 219/626 |
| 2004/0054486 | A1 * | 3/2004 | Schilling et al. | 702/99 |
| 2006/0243723 | A1 * | 11/2006 | Cornec et al. | 219/660 |
| 2007/0135037 | A1 * | 6/2007 | Barragan Perez et al. | 455/7 |
| 2008/0087661 | A1 * | 4/2008 | Haag et al. | 219/620 |
| 2009/0139980 | A1 * | 6/2009 | Acero Acero et al. | 219/489 |

FOREIGN PATENT DOCUMENTS

| | | | | |
|---|---|---|---|---|
| CN | 101208994 | | 6/2008 | |
| JP | 2003257608 | A * | 9/2003 | H05B 6/12 |
| WO | 2006/117182 | * | 11/2006 | |

* cited by examiner

*Primary Examiner* — Fernando L Toledo
*Assistant Examiner* — Peter Bradford
(74) *Attorney, Agent, or Firm* — Evan R. Witt; Kirton McConkie

(57) ABSTRACT

A heating device includes a first induction coil, a second induction coil, a control panel, a power supply unit and a controlling unit. The control panel issues an adjusting signal. The power supply unit provides a first power and a second power to the first induction coil and the second induction coil, respectively. The controlling unit generates a control signal to the power supply unit according to the adjusting signal, thereby controlling the first power and the second power. Electrical energy is transmitted to the first induction coil and the second induction coil and the frequency difference between the first power and the second power is greater than 15 kHz or smaller than 1 kHz during a first time interval under control of the controlling unit. No electrical energy is transmitted to one of the first induction coil and the second induction coil during a second time interval under control of the controlling unit.

11 Claims, 7 Drawing Sheets

HEATING DEVICE CAPABLE OF ELIMINATING NOISE AND ADJUSTING DESIRED HEAT QUALITY OR HEATING TEMPERATURE BY CONTROLLING FREQUENCY DIFFERENCE BETWEEN TWO INDUCTION COILS DURING A FIRST TIME INTERVAL AND DISABLING ONE OF TWO INDUCTION COILS DURING A SECOND TIME INTERVAL

FIELD OF THE INVENTION

The present invention relates to a heating device, and more particularly to a heating device for simultaneously heating multiple foodstuff containers.

BACKGROUND OF THE INVENTION

Nowadays, a variety of cooking utensils such as gas stoves, infrared oven, microwave oven and electric stove are widely used to cook food. Different cooking utensils have their advantages or disadvantages. Depending on the food to be cooked, a desired cooking utensil is selected.

Take an induction cooking stove for example. When a current flows through the induction coil of the induction cooking stove, electromagnetic induction is performed to produce eddy current, thereby heating a foodstuff container. For simultaneously heating multiple foodstuff containers, the heating device needs to have multiple induction coils. By adjusting the electricity quantities to the induction coils, the heating temperatures of respective induction coils are determined.

When multiple induction coils are used to heat foodstuff containers, the induction coils have respective operating frequency values. If the frequency difference between any two induction coils lies within the human hearing range, undesired noise is generated. The user usually feels uncomfortable when hearing the noise. Moreover, since the volume of the noise is varied according to the food type, the food amount, the foodstuff container size and foodstuff container type, the user may mistake a breakdown of the heating device. If the heating device returned to the depot service, unnecessary inspecting cost and time are required.

There is a need of providing an improved heating device so as to obviate the drawbacks encountered from the prior art.

SUMMARY OF THE INVENTION

It is an object of the present invention to provide a heating device for simultaneously heating multiple foodstuff containers in order to eliminate noise and adjust desired heat quality or heating temperature.

In accordance with an aspect of the present invention, there is provided a heating device for heating at least one foodstuff container. The heating device includes a first induction coil, a second induction coil, a control panel, a power supply unit and a controlling unit. The control panel is operated to issue an adjusting signal. The power supply unit is connected with the first induction coil and the second induction coil for providing a first power and a second power to the first induction coil and the second induction coil, respectively. The controlling unit is connected with the control panel and the power supply unit and generates a control signal to the power supply unit according to the adjusting signal, thereby controlling the first power and the second power of the power supply unit. Electrical energy is transmitted to the first induction coil and the second induction coil and the frequency difference between the first power and the second power is greater than 15 kHz or smaller than 1 kHz during a first time interval under control of the controlling unit. No electrical energy is transmitted to one of the first induction coil and the second induction coil during a second time interval under control of the controlling unit.

In accordance with another aspect of the present invention, there is provided a heating device for heating at least one foodstuff container. The heating device includes a first induction coil, a second induction coil, a control panel, a power supply unit and a controlling unit. The control panel is operated to issue an adjusting signal. The power supply unit is connected with the first induction coil and the second induction coil for providing a first power and a second power to the first induction coil and the second induction coil, respectively. The controlling unit is connected with the control panel and the power supply unit and generates a control signal to the power supply unit according to the adjusting signal, thereby controlling the first power and the second power of the power supply unit. The frequency difference between the first power and the second power is greater than 15 kHz during a first time interval and during a third time interval. The frequency difference between the first power and the second power is smaller than 1 kHz during a second time interval.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
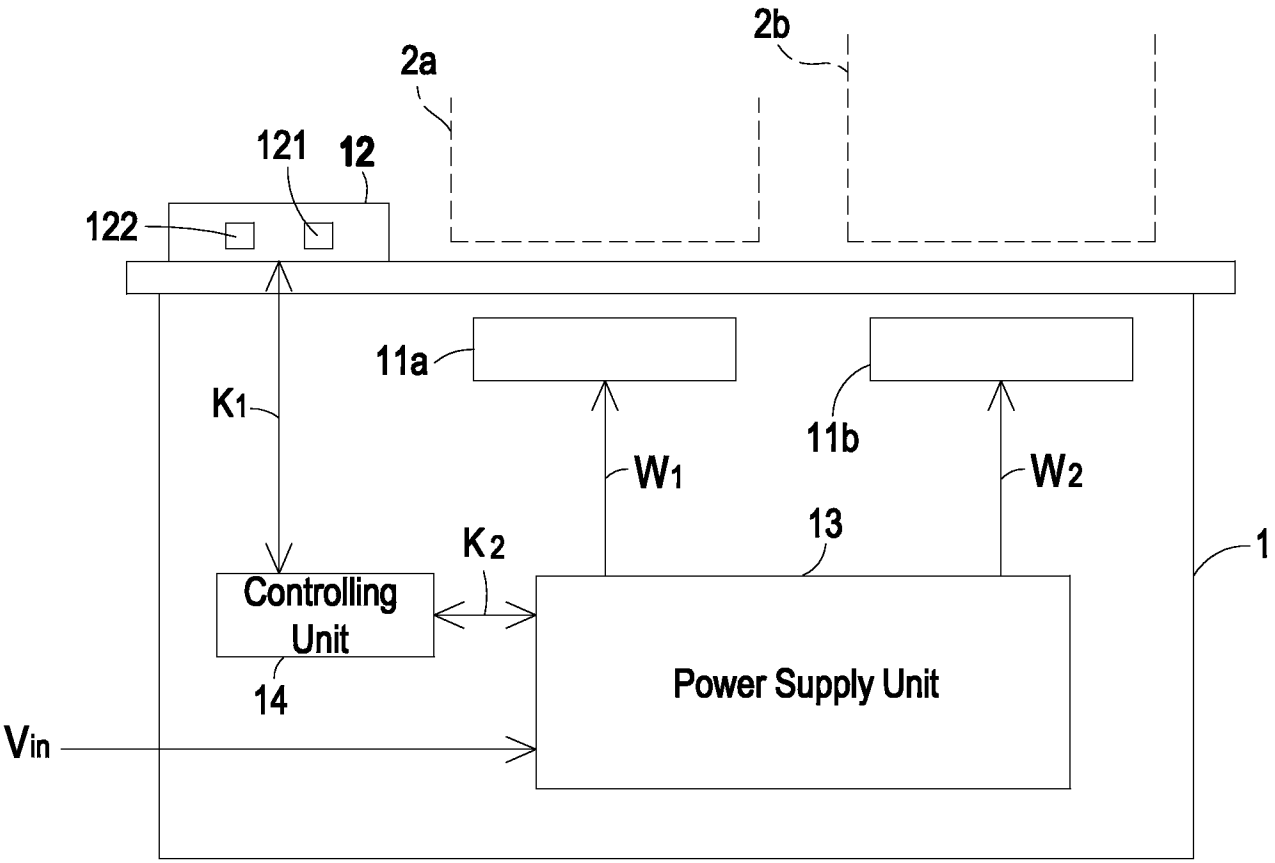
FIG. 1 is a schematic functional block diagram illustrating a heating device according to a first embodiment of the present invention.

FIG. 1 is a schematic functional block diagram illustrating a heating device according to a first embodiment of the present invention. The heating device 1 comprises a first induction coil 11*a*, a second induction coil 11*b*, a control panel 12, a power supply unit 13 and a controlling unit 14. When a current flows through the first induction coil 11*a* and the second induction coil 11*b*, electromagnetic induction is performed to produce eddy current, thereby heating a first foodstuff container 2*a* and a second foodstuff container 2*b*. The first induction coil 11*a* and the second induction coil 11*b* are connected to a first power output terminal and a second power output terminal of the power supply unit 13, respectively.

The control panel 12 is disposed on the outer surface of the heating device 1 and connected to the controlling unit 14. By operating the control panel 12, a corresponding adjusting signal $K_1$ is transmitted to the controlling unit 14. According to the adjusting signal $K_1$, the amount of heating energy outputted from the first induction coil 11*a* and the second induction coil 11*b* are adjusted. The power supply unit 13 is connected to the first induction coil 11*a* and the second induction coil 11*b* for providing a first power signal $W_1$ and a second power signal $W_2$ to the first induction coil 11*a* and the second induction coil 11*b*, respectively. The controlling unit 14 is connected to the control panel 12 and the power supply unit 13. According to the adjusting signal $K_1$, the controlling unit 14 issues a control signal $K_2$ to the power supply unit 13. According to the control signal $K_2$, the power supply unit 13 provides the first power signal $W_1$ and the second power signal $W_2$ to the first induction coil 11*a* and the second induction coil 11*b*, respectively. An example of the controlling unit 14 includes but is not limited to a pulse frequency modulation (PFM) controller or a digital signal processor (DSP).

In an embodiment, the power supply unit 13 is an AC-to-AC converting circuit. The electricity quantity outputted from the power supply unit 13 to the first induction coil 11*a* is in reverse proportion to the magnitude of the first frequency $f_1$ of the first power signal $W_1$. Similarly, the electricity quantity outputted from the power supply unit 13 to the second induction coil 11*b* is in reverse proportion to the magnitude of the second frequency $f_2$ of the second power signal $W_2$. By the power supply unit 13, an input AC voltage $V_{in}$ is converted into the first power signal $W_1$ and the second power signal $W_2$. As the adjusting signal $K_1$ is altered, the control signal $K_2$ is changed. According to the control signal $K_2$, the first frequency $f_1$ of the first power signal $W_1$ and the second frequency $f_2$ of the second power signal $W_2$ are adjusted, and thus the electricity quantity outputted from the power supply unit 13 to the first induction coil 11*a* or the second induction coil 11*b* is adjusted. In other words, the amount of heating energy outputted from the first induction coil 11*a* and the second induction coil 11*b* to respectively heat the first foodstuff container 2*a* and the second foodstuff container 2*b* will be adjusted.

In an embodiment, the control panel 12 comprises two operating elements 121 and 122. The operating elements 121 and 122 are button-type operating elements or rotary operating elements. The operating elements 121 and 122 are manipulated by a user in order to adjust the temperature or heat quantity to be applied to the first foodstuff container 2*a* and the second foodstuff container 2*b*. By operating the operating elements 121 and 122 to select desired temperature or heat quantity, a corresponding adjusting signal $K_1$ is transmitted from the control panel 12 to the controlling unit 14. After the adjusting signal $K_1$ is received, the controlling unit 14 issues a control signal $K_2$ to the power supply unit 13 by computation. According to the control signal $K_2$, the first frequency $f_1$ of the first power signal $W_1$ and the second frequency $f_2$ of the second power signal $W_2$ are determined.

In some embodiments, the first induction coil 11*a* and the second induction coil 11*b* are used to heat the first foodstuff container 2*a* and the second foodstuff container 2*b*, respectively. In some embodiments, the first induction coil 11*a* and the second induction coil 11*b* collectively heat a single foodstuff container (not shown). Hereinafter, the first foodstuff container 2*a* and the second foodstuff container 2*b* respectively heated by the first induction coil 11*a* and the second induction coil 11*b* will be illustrated.

Figure 2A:
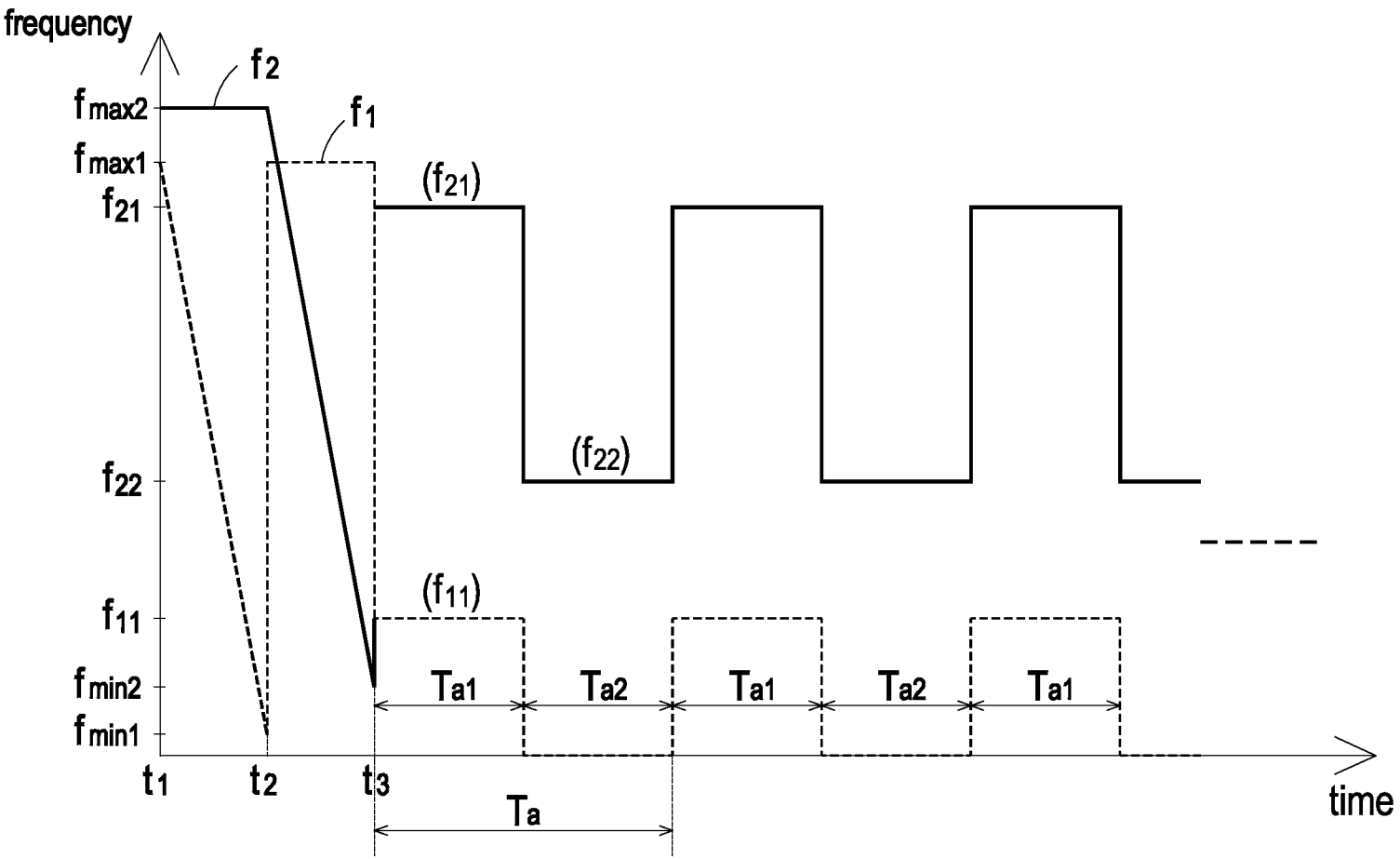
FIG. 2A is a timing waveform diagram schematically illustrating the first frequency and the second frequency processed in the heating device of FIG. 1 according to a first implementing example.

FIG. 2A is a timing waveform diagram schematically illustrating the first frequency and the second frequency processed in the heating device of FIG. 1 according to a first implementing example. Before $t=t_1$, the heating device 1 is disabled and no electricity is supplied to the first induction coil 11*a* and the second induction coil 11*b*. As such, the magnitudes of the first power signal $W_1$ and the second power signal $W_2$ are zero, and no heating operations are done by the first induction coil 11*a* and the second induction coil 11*b*.

At $t=t_1$, the heating device 1 is enabled. At $t=t_3$, the heating device 1 starts the heating operation. In some embodiments, the controlling unit 14 could detect some heating parameters from $t=t_1$ to $t=t_3$. The heating parameters include for example a first minimum frequency value $f_{min1}$, a second minimum frequency value $f_{min2}$, a first minimum power value $P_{min1}$ and a second minimum power value $P_{min2}$.

From $t=t_1$ to $t=t_2$, the second frequency $f_2$ of the second power signal $W_2$ is maintained at a second maximum frequency value $f_{max2}$ and thus the second minimum power value $P_{min2}$ is inputted to the second induction coil 11*b*. Under control of the controlling unit 14, the first frequency $f_1$ of the first power signal $W_1$ is gradually decreased from a first maximum frequency value $f_{max1}$ to the first minimum frequency value $f_{min1}$. In other words, the power value inputted to the first induction coil 11*a* is gradually increased from the first minimum power value $P_{min1}$ to a first maximum power value $P_{max1}$.

From $t=t_2$ to $t=t_3$, the first frequency $f_1$ of the first power signal $W_1$ is maintained at the first maximum frequency value $f_{max1}$ and thus the first minimum power value $P_{min1}$ is inputted into the first induction coil 11*a*. Under control of the controlling unit 14, the second frequency $f_2$ of the second power signal $W_2$ is gradually decreased from the second maximum frequency value $f_{max2}$ to the second minimum frequency value $f_{min2}$. In other words, the power value inputted to the second induction coil 11*b* is gradually increased from the second minimum power value $P_{min2}$ to a second maximum power value $P_{max2}$.

In some embodiments, the second power signal $W_2$ is zero from $t=t_1$ to $t=t_2$ such that no power is inputted to the second induction coil 11*b*; and the first power signal $W_1$ is zero from $t=t_2$ to $t=t_3$ such that no power is inputted to the first induction coil 11*a*.

At $t=t_3$, the heating device 1 starts the heating operation. Due to electromagnetic induction, the first foodstuff container 2*a* and the second foodstuff container 2*b* are heated by the first induction coil 11*a* and the second induction coil 11*b*, respectively. The heating time period includes multiple alternating first time intervals $T_{a1}$ and second time intervals $T_{a2}$. During the first time interval $T_{a1}$, the first frequency $f_1$ and the second frequency $f_2$ are both greater than the upper limit of human hearing range; and the difference between the first frequency $f_1$ and the second frequency $f_2$ is greater than the upper limit of human hearing range or smaller than the lower limit of human hearing range. In this context, the upper limit of human hearing range is approximately 15 kHz~25 kHz and the lower limit of human hearing range is approximately 1 kHz.

As shown in FIG. 2A, during the first time interval $T_{a1}$, the first frequency $f_1$ of the first power signal $W_1$ and the second frequency $f_2$ of the second power signal $W_2$ are respectively maintained at the frequency values $f_{11}$ and $f_{21}$, wherein $f_{11}$ is smaller than $f_{21}$. Since the power values inputted into the first induction coil 11*a* and the second induction coil 11*b* are respectively in reverse proportion to $f_{11}$ and $f_{21}$, the electrical energy outputted from the power supply unit 13 is mostly transmitted to the first induction coil 11*a* to heat the first foodstuff container 2*a*.

Please refer to FIG. 2A again. During the second time interval $T_{a2}$, the first power signal $W_1$ is zero and thus the first foodstuff container 2*a* is not heated by the first induction coil 11*a*. During the second time interval $T_{a2}$, the second frequency $f_2$ of the second power signal $W_2$ is maintained at the frequency value $f_{22}$, wherein the frequency value $f_{22}$ is greater than the upper limit of human hearing range. Since the first power signal $W_1$ is zero, the electrical energy outputted from the power supply unit 13 is totally transmitted to the second induction coil 11*b* to heat the second foodstuff container 2*b*.

Since the difference between the first frequency $f_1$ and the second frequency $f_2$ beyond the human hearing range during the first time interval $T_{a1}$ is effective to eliminate the noise, there are still some drawbacks. For example, the electricity quantities outputted from the power supply unit 13 to the first induction coil 11*a* and the second induction coil 11*b* fail to be respectively controlled. In other words, either the first frequency $f_1$ or the second frequency $f_2$ is usable during the first time interval $T_{a1}$. As such, the temperature or heat quantity to be applied to either the first foodstuff container 2*a* or the second foodstuff container 2*b* is adjustable.

Please refer to FIG. 2A again. During the first time interval $T_{a1}$, the first frequency $f_1$ of the first power signal $W_1$ is adjusted to the frequency value $f_{11}$ according to the adjusting signal $K_1$ under control of the controlling unit 14. As such, desired heat quantity to be applied to the first foodstuff container 2*a* is adjusted. On the other hand, since the frequency value $f_{21}$ needs to meet the frequency difference requirement (i.e. greater than the upper limit of human hearing range or smaller than the lower limit of human hearing range), the frequency value $f_{21}$ fails to accurately reflect the desired heat quantity.

During the second time interval $T_{a2}$, the first power signal $W_1$ is zero and the second frequency $f_2$ of the second power signal $W_2$ is maintained at the frequency values $f_{22}$. Since the frequency values $f_{22}$ is greater than the upper limit of human hearing range, no hearable noise is generated. Under this circumstance, the second frequency $f_2$ of the second power signal $W_2$ is adjusted to the frequency values $f_{22}$ according to the adjusting signal $K_1$ under control of the controlling unit 14. As such, desired heat quantity to be applied to the second foodstuff container 2*b* is adjusted.

In this embodiment, a first average heat quantity $P_1$ offered from the first induction coil 11*a* to the first foodstuff container 2*a* and a second average heat quantity $P_2$ offered from the second induction coil 11*b* to the second foodstuff container 2*b* could be deduced according to the following formulas:

$$P_1 = P_{11}(f_{11}) \cdot \frac{T_{a1}}{T_{a1} + T_{a2}}$$

-continued $$= P_{11}(f_{11}) \cdot \frac{T_{a1}}{T_a}$$

$$P_2 = P_{21}(f_{21}) \cdot \frac{T_{a1}}{T_{a1} + T_{a2}} + P_{22}(f_{22}) \cdot \frac{T_{a2}}{T_{a1} + T_{a2}}$$

$$= P_{21}(f_{21}) \cdot \frac{T_{a1}}{T_a} + P_{22}(f_{22}) \cdot \frac{T_{a2}}{T_a}$$

where, $P_{11}$ is a function of the frequency values $f_{11}$ and denotes the heat quantity offered from the first induction coil 11*a* to the first foodstuff container 2*a* during the first time interval $T_{a1}$, $P_{21}$ is a function of the frequency values $f_{21}$ and denotes the heat quantity offered from the second induction coil 11*b* to the second foodstuff container 2*b* during the first time interval $T_{a1}$, $P_{22}$ is a function of the frequency values $f_{22}$ and denotes the heat quantity offered from the second induction coil 11*b* to the second foodstuff container 2*b* during the second time interval $T_{a2}$; and $T_a$ denotes a heating cycle, which is equal to the sum of the first time interval $T_{a1}$ and the second time interval $T_{a2}$.

From the above formulae, it is found that a desired first average heat quantity $P_1$ is obtained by adjusting the duration of the first time interval $T_{a1}$. Similarly, a desired second average heat quantity $P_2$ is obtained by adjusting the duration of the first time interval $T_{a1}$ or the second time interval $T_{a2}$. In particular, by adjusting the frequency values $f_{22}$, the duration of the first time interval $T_{a1}$ or the second time interval $T_{a2}$, a desired second average heat quantity $P_2$ is obtained.

The first maximum power value $P_{max1}$ (or the first minimum frequency value $f_{min1}$) and the first minimum power value $P_{min1}$ (or the first maximum frequency value $f_{max1}$) of the first induction coil 11*a* are dependent on the size and material of the first foodstuff container 2*a*. In addition, the second maximum power value $P_{max2}$ (or the second minimum frequency value $f_{min2}$) and the second minimum power value $P_{min2}$ (or the second maximum frequency value $f_{max2}$) of the second induction coil 11*b* is dependent on the size and material of the second foodstuff container 2*b*. That is, the first minimum frequency value $f_{min1}$, the second minimum frequency value $f_{min2}$, the first minimum power value $P_{min1}$ and the second minimum power value $P_{min2}$ are not constant.

The induction heat quantity of the first induction coil 11*a* involves the first minimum frequency value $f_{min1}$ and the first minimum power value $P_{min1}$ (not shown in the formula of the first average heat quantity $P_1$). The induction heat quantity of the second induction coil 11*b* involves the second minimum frequency value $f_{min2}$ and the second minimum power value $P_{min2}$ (not shown in the formula of the second average heat quantity $P_2$). The control signal $K_2$ is calculated by the controlling unit 14 according to the adjusting signal $K_1$, the first minimum frequency value $f_{min1}$, the first minimum power value $P_{min1}$, the second minimum frequency value $f_{min2}$ and the second minimum power value $P_{min2}$. If these values $f_{min1}$, $P_{min1}$, $f_{min2}$ and $P_{min2}$ are constant, the error of the control signal $K_2$ is too large and thus the heating device fails to achieve the desired heating temperature or heat quantity.

Before the heating operation is performed, the controlling unit 14 would detect the accurate values $f_{min1}$, $P_{min1}$, $f_{min2}$ and $P_{min2}$. In addition, the first time interval $T_{a1}$, the second time interval $T_{a2}$, the heat quantity $P_{11}$, $P_{21}$ and $P_{22}$ are determined by the controlling unit 14 according to the accurate values $f_{min1}$, $P_{min1}$, $f_{min2}$ and $P_{min2}$. As a consequence, the control signal $K_2$ is accurately generated and thus the heating device fails to achieve the desired heating temperature or heat quantity.

Figure 2B:
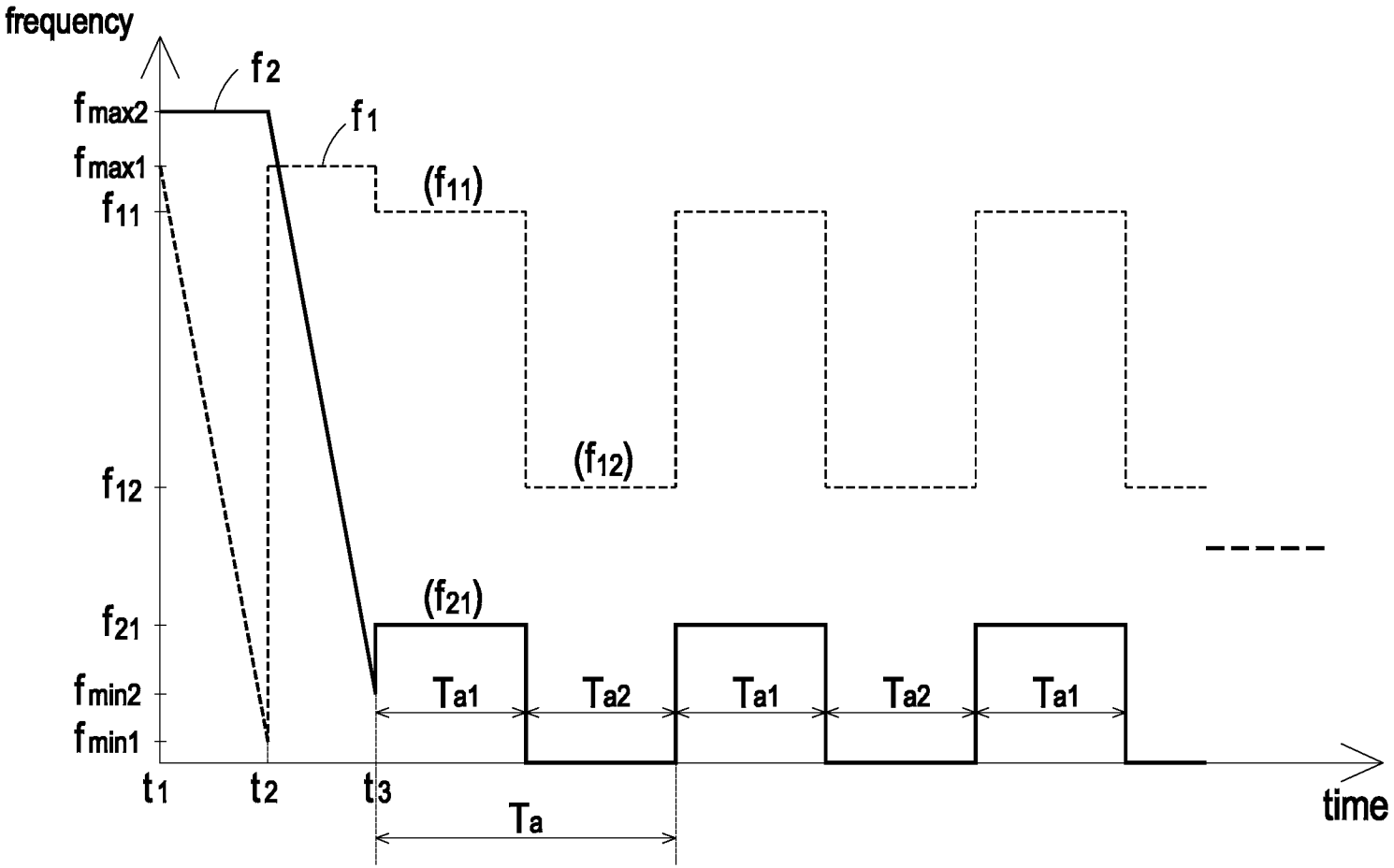
FIG. 2B is a timing waveform diagram schematically illustrating the first frequency and the second frequency processed in the heating device of FIG. 1 according to a second implementing example.

FIG. 2B is a timing waveform diagram schematically illustrating the first frequency and the second frequency processed in the heating device of FIG. 1 according to a second implementing example. In comparison with FIG. 2A, during the first time interval $T_{a1}$, the second frequency $f_2$ of the second power signal $W_2$ is adjusted to the frequency values $f_{21}$ according to the adjusting signal $K_1$ under control of the controlling unit 14. As such, desired heat quantity or temperature to be applied to the second foodstuff container 2*b* is adjusted. In addition, the difference between the frequency value $f_{11}$ and the frequency value $f_{21}$ is greater than the upper limit of human hearing range or smaller than the lower limit of human hearing range. During the second time interval $T_{a2}$, the second power signal $W_2$ is zero and thus the second foodstuff container 2*b* is not heated by the second induction coil 11*b*. The frequency value $f_{12}$ is greater than the upper limit of human hearing range. Since the second power signal $W_2$ is zero, the electrical energy outputted from the power supply unit 13 is totally transmitted to the first induction coil 11*a* to heat the first foodstuff container 2*a*.

In this embodiment, a first average heat quantity $P_1$ offered from the first induction coil 11*a* to the first foodstuff container 2*a* and a second average heat quantity $P_2$ offered from the second induction coil 11*b* to the second foodstuff container 2*b* could be deduced according to the following formulas:

$$P_1 = P_{11}(f_{11}) \cdot \frac{T_{a1}}{T_a} + P_{12}(f_{12}) \cdot \frac{T_{a2}}{T_a}$$

$$P_2 = P_{21}(f_{21}) \cdot \frac{T_{a1}}{T_a}$$

where, $P_{11}$ is a function of the frequency values $f_{11}$ and denotes the heat quantity offered from the first induction coil 11*a* to the first foodstuff container 2*a* during the first time interval $T_{a1}$;

$P_{12}$ is a function of the frequency values $f_{12}$ and denotes the heat quantity offered from the first induction coil 11*a* to the first foodstuff container 2*a* during the second time interval $T_{a2}$;

$P_{21}$ is a function of the frequency values $f_{21}$ and denotes the heat quantity offered from the second induction coil 11*b* to the second foodstuff container 2*b* during the first time interval $T_{a1}$; and $T_a$ denotes a heating cycle, which is equal to the sum of the first time interval $T_{a1}$ and the second time interval $T_{a2}$.

Figure 2C:
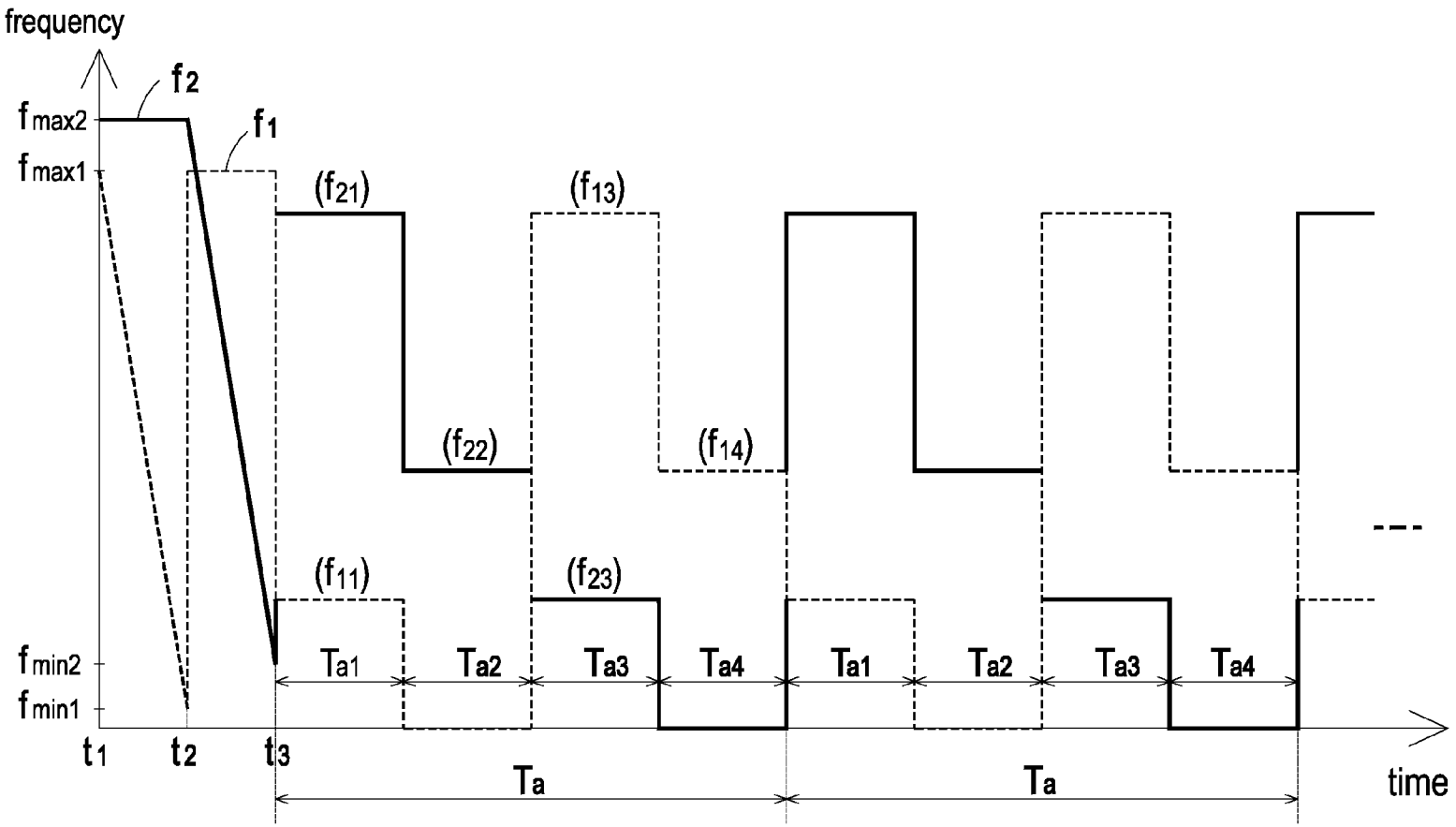
FIG. 2C is a timing waveform diagram schematically illustrating the first frequency and the second frequency processed in the heating device of FIG. 1 according to a third implementing example.

FIG. 2C is a timing waveform diagram schematically illustrating the first frequency and the second frequency processed in the heating device of FIG. 1 according to a third implementing example. In comparison with FIG. 2A, the heating cycle includes a first time interval $T_{a1}$, a second time interval $T_{a2}$, a third time interval $T_{a3}$ and a fourth time interval $T_{a4}$. During the first time interval $T_{a1}$, the heat quantity to be applied to the first foodstuff container 2*a* is dependent on the frequency value $f_{11}$. The difference between the frequency value $f_{11}$ and the frequency value $f_{21}$ is greater than the upper limit of human hearing range or smaller than the lower limit of human hearing range. During the second time interval $T_{a2}$, the first power signal $W_1$ is zero and the heat quantity to be applied to the second foodstuff container 2*b* is dependent on the frequency values $f_{22}$. The frequency value $f_{22}$ is greater than the upper limit of human hearing range. During the third time interval $T_{a3}$, the heat quantity to be applied to the second foodstuff container 2*b* is dependent on the frequency value $f_{23}$. The difference between the frequency value $f_{13}$ and the frequency value $f_{23}$ is greater than the upper limit of human hearing range or smaller than the lower limit of human hearing range. During the forth time interval $T_{a4}$, the second power signal $W_2$ is zero and the heat quantity to be applied to the first foodstuff container 2*a* is dependent on the frequency values $f_{14}$. The frequency value $f_{14}$ is greater than the upper limit of human hearing range.

Figure 2D:
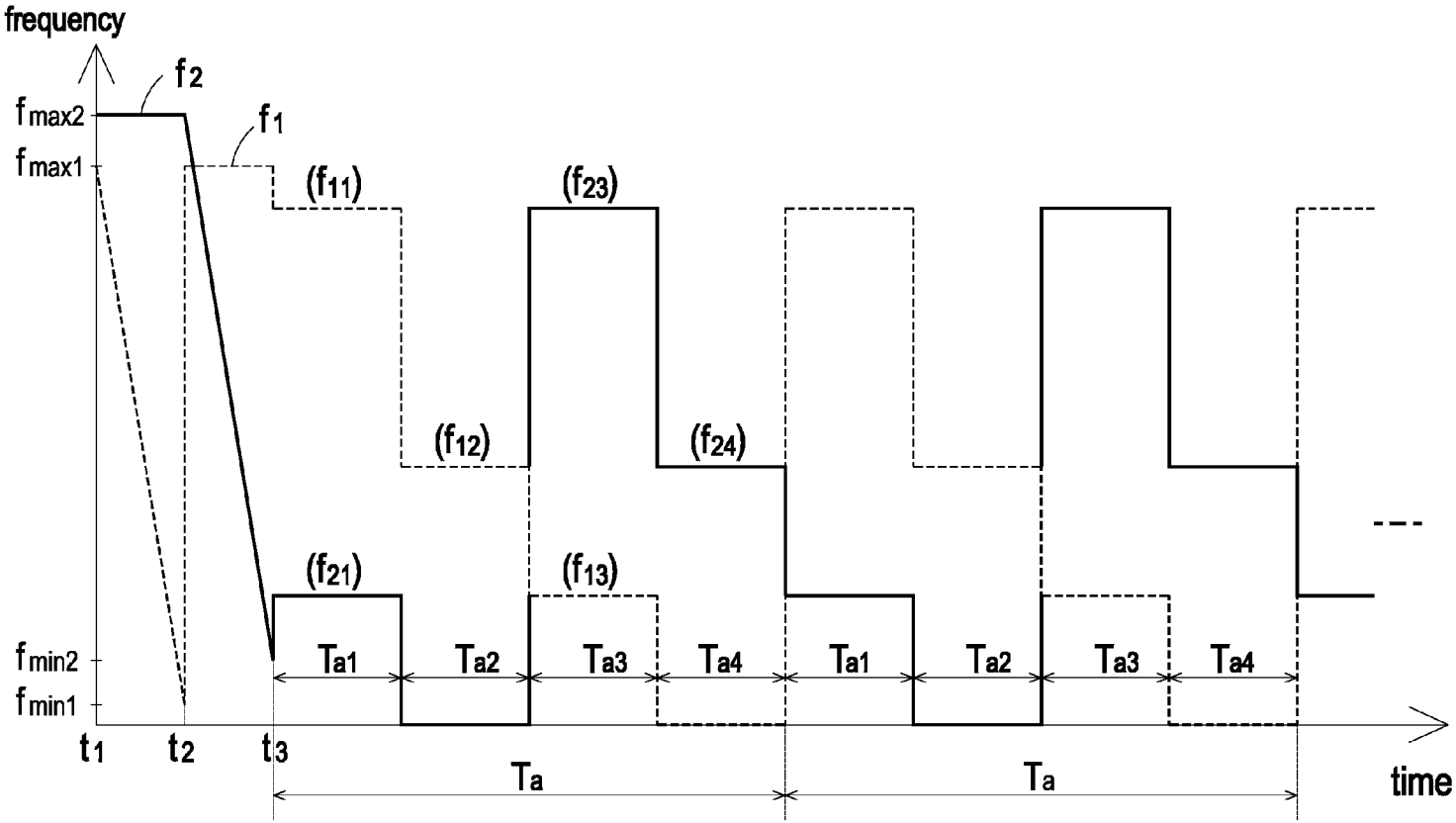
FIG. 2D is a timing waveform diagram schematically illustrating the first frequency and the second frequency processed in the heating device of FIG. 1 according to a fourth implementing example.

FIG. 2D is a timing waveform diagram schematically illustrating the first frequency and the second frequency processed in the heating device of FIG. 1 according to a fourth implementing example. The heating cycle includes a first time interval $T_{a1}$, a second time interval $T_{a2}$, a third time interval $T_{a3}$ and a fourth time interval $T_{a4}$. During the first time interval $T_{a1}$, the heat quantity to be applied to second foodstuff container 2*b* is dependent on the frequency value $f_{21}$. The difference between the frequency value $f_{11}$ and the frequency value $f_{21}$ is greater than the upper limit of human hearing range or smaller than the lower limit of human hearing range. During the second time interval $T_{a2}$, the second power signal $W_2$ is zero and the heat quantity to be applied to the first foodstuff container 2*a* is dependent on the frequency value $f_{12}$. The frequency value $f_{12}$ is greater than the upper limit of human hearing range. During the third time interval $T_{a3}$, the heat quantity to be applied to the first foodstuff container 2*a* is dependent on the frequency value $f_{13}$. The difference between the frequency value $f_{13}$ and the frequency value $f_{23}$ is greater than the upper limit of human hearing range or smaller than the lower limit of human hearing range. During the forth time interval $T_{a4}$, the first power signal $W_1$ is zero and the heat quantity to be applied to the second foodstuff container 2*b* is dependent on the frequency value $f_{24}$. The frequency value $f_{24}$ is greater than the upper limit of human hearing range.

In FIGS. 2C and 2D, the heat quantity or heating temperature of the first foodstuff container 2*a* or the second foodstuff container 2*b* could be controlled by the controlling unit 14 according to various heating parameters, including the time interval $T_{a1}$, $T_{a2}$, $T_{a3}$, $T_{a4}$ and the frequency values $f_{11}$, $f_{21}$, $f_{12}$, $f_{22}$, $f_{13}$, $f_{23}$, $f_{14}$ and/or $f_{24}$.

Figure 3A:
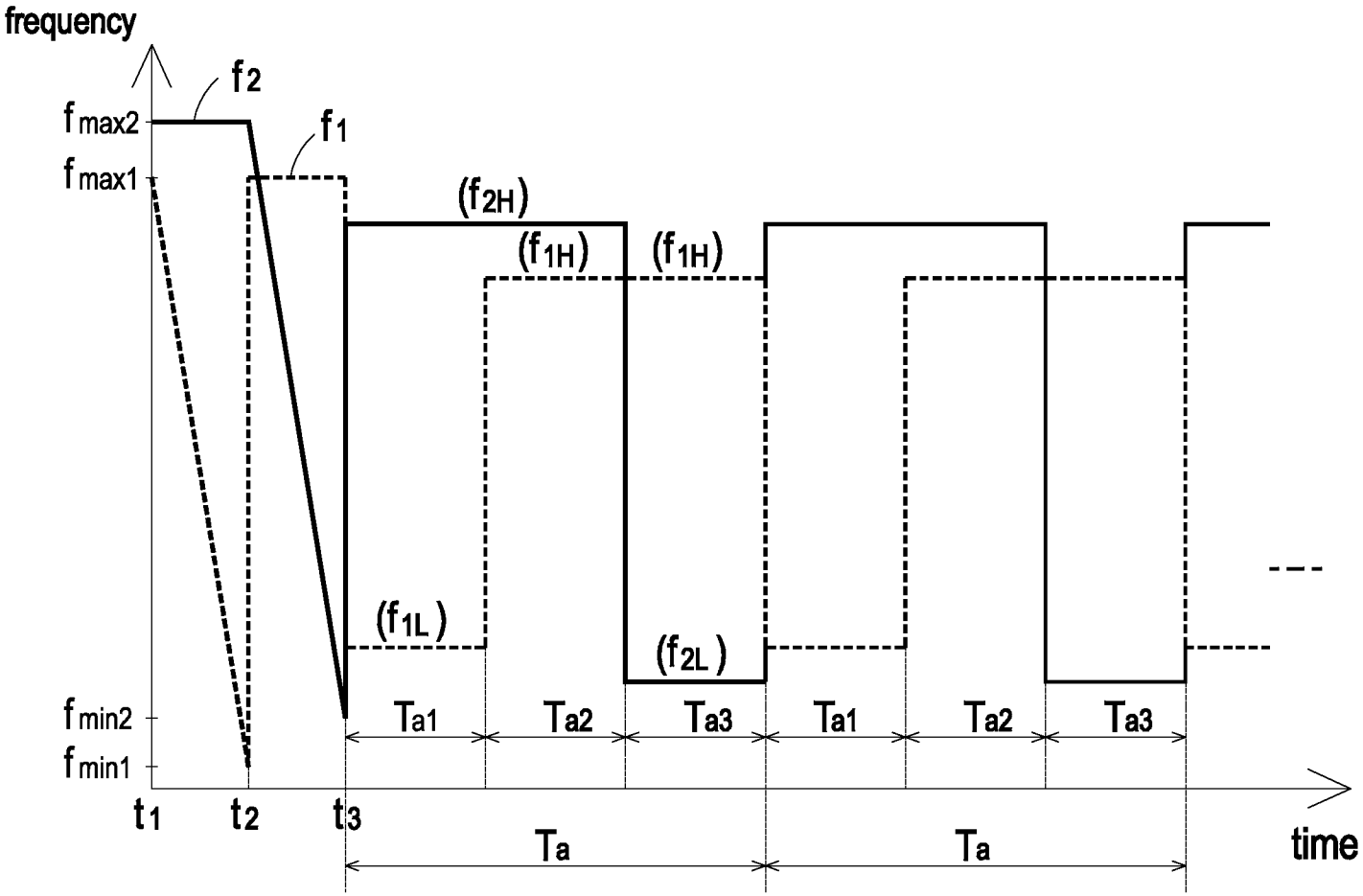
FIG. 3A is a timing waveform diagram schematically illustrating the first frequency and the second frequency processed in the heating device of FIG. 1 according to a fifth implementing example.

FIG. 3A is a timing waveform diagram schematically illustrating the first frequency and the second frequency processed in the heating device of FIG. 1 according to a fifth implementing example.

At $t=t_1$, the heating device 1 is enabled. At $t=t_3$, the heating device 1 starts the heating operation. In some embodiments, the controlling unit 14 could detect some heating parameters from $t=t_1$ to $t=t_3$. The heating parameters include for example a first minimum frequency value $f_{min1}$, a second minimum frequency value $f_{min2}$, a first minimum power value $P_{min1}$ and a second minimum power value $P_{min2}$. The heating time period $T_a$ includes multiple alternating first time intervals $T_{a1}$, second time intervals $T_{a2}$ and third time interval $T_{a3}$. In other words, a heating cycle $T_a$ includes a first time interval $T_{a1}$, a second time interval $T_{a2}$ and a third time interval $T_{a3}$. For each heating time period $T_a$, the first frequency $f_1$ and the second frequency $f_2$ are both greater than the upper limit of human hearing range. During the first time intervals $T_{a1}$ and the third time interval $T_{a3}$, the difference between the first frequency $f_1$ and the second frequency $f_2$ is greater than the upper limit of human hearing range. During the second time interval $T_{a2}$, the difference between the first frequency $f_1$ and the second frequency $f_2$ is smaller than the lower limit of human hearing range. During the second time interval $T_{a2}$, the first frequency $f_1$ and the second frequency $f_2$ are maintained at the high frequency values $f_{1H}$ and $f_{2H}$, respectively.

During the first time interval $T_{a1}$, the first frequency $f_1$ and the second frequency $f_2$ are maintained at the low frequency value $f_{1L}$ and the high frequency value $f_{2H}$, respectively. During the third time interval $T_{a3}$, the first frequency $f_1$ and the second frequency $f_2$ are maintained at the high frequency value $f_{1H}$ and the low frequency value $f_{2L}$, respectively. In a case that the first frequency $f_1$ is maintained at the low frequency value $f_{1L}$ during the first time interval $T_{a1}$, the first frequency $f_1$ is maintained at the high frequency value $f_{1H}$ during the third time interval $T_{a3}$. In a case that the first frequency $f_1$ is maintained at the high frequency value $f_{1H}$ during the first time interval $T_{a1}$, the first frequency $f_1$ is maintained at the low frequency value $f_{1L}$ during the third time interval $T_{a3}$. Similarly, in a case that the second frequency $f_2$ is maintained at the low frequency value $f_{2L}$ during the first time interval $T_{a1}$, the second frequency $f_2$ is maintained at the high frequency value $f_{2H}$ during the third time interval $T_{a3}$. In a case that the second frequency $f_2$ is maintained at the high frequency value $f_{2H}$ during the first time interval $T_{a1}$, the second frequency $f_2$ is maintained at the low frequency value $f_{2L}$ during the third time interval $T_{a3}$.

Please refer to FIG. 3A again. The first frequency $f_1$ and the second frequency $f_2$ are respectively maintained at the low frequency value $f_{1L}$ and the high frequency value $f_{2H}$ during the first time interval $T_{a1}$, the first frequency $f_1$ and the second frequency $f_2$ are respectively maintained at the high frequency values $f_{1H}$ and $f_{2H}$ during the second time interval $T_{a1}$; and the first frequency $f_1$ and the second frequency $f_2$ are respectively maintained at the high frequency value $f_{1H}$ and the low frequency value $f_{2L}$ during the third time interval $T_{a3}$.

In this embodiment, a first average heat quantity $P_1$ offered from the first induction coil 11*a* to the first foodstuff container 2*a* and a second average heat quantity $P_2$ offered from the second induction coil 11*b* to the second foodstuff container 2*b* could be deduced according to the following formulas:

$$P_1 = P_{1L}(f_{1L}) \cdot \frac{T_{a1}}{T_a} + P_{1H}(f_{1H}) \cdot \frac{T_{a2} + T_{a3}}{T_a}$$

$$P_2 = P_{2L}(f_{2L}) \cdot \frac{T_{a3}}{T_a} + P_{2H}(f_{2H}) \cdot \frac{T_{a1} + T_{a2}}{T_a}$$

where, $P_{1L}$ is a function of the low frequency values $f_{1L}$ and denotes the heat quantity offered from the first induction coil 11*a* to the first foodstuff container 2*a;*

$P_{1H}$ is a function of the high frequency values $f_{1H}$ and denotes the heat quantity offered from the first induction coil 11*a* to the first foodstuff container 2*a;*

$P_{2L}$ is a function of the low frequency values $f_{2L}$ and denotes the heat quantity offered from the second induction coil 11*b* to the second foodstuff container 2*b*; and $P_{2H}$ is a function of the high frequency values $f_{2H}$ and denotes the heat quantity offered from the second induction coil 11*b* to the second foodstuff container 2*b*.

Please refer to FIG. 3A again. During the first time interval $T_{a1}$, the first frequency $f_1$ of the first power signal $W_1$ is adjusted to the low frequency value $f_{1L}$ according to the adjusting signal $K_1$ under control of the controlling unit 14. As such, desired heat quantity to be applied to the first foodstuff container 2*a* is adjusted. The second frequency $f_2$ is adjusted to the high frequency value $f_{2H}$ such that the difference between the low frequency value $f_{1L}$ and the high frequency value $f_{2H}$ is greater than the upper limit of human hearing range or smaller than the lower limit of human hearing range. During the third time interval $T_{a3}$, the second frequency $f_2$ of the second power signal $W_2$ is adjusted to the low frequency value $f_{2L}$ according to the adjusting signal $K_1$ under control of the controlling unit 14. As such, desired heat quantity to be applied to the second foodstuff container 2*b* is adjusted. The first frequency $f_1$ is adjusted to the high frequency value $f_{1H}$ such that the difference between the high frequency value $f_{1H}$ and the low frequency value $f_{2L}$ is greater than the upper limit of human hearing range or smaller than the lower limit of human hearing range.

Under control of the controlling unit 14, a desired first average heat quantity $P_1$ and a desired second average heat quantity $P_2$ are obtained by adjusting the first frequency $f_1$ and the second frequency $f_2$ to the low frequency value $f_{1L}$ and $f_{2L}$ during the first time interval $T_{a1}$ and the third time interval $T_{a3}$. In some embodiments, a desired first average heat quantity $P_1$ and a desired second average heat quantity $P_2$ are obtained by adjusting the first time interval $T_{a1}$, the second time interval $T_{a2}$ and the third time interval $T_{a3}$.

Figure 3B:
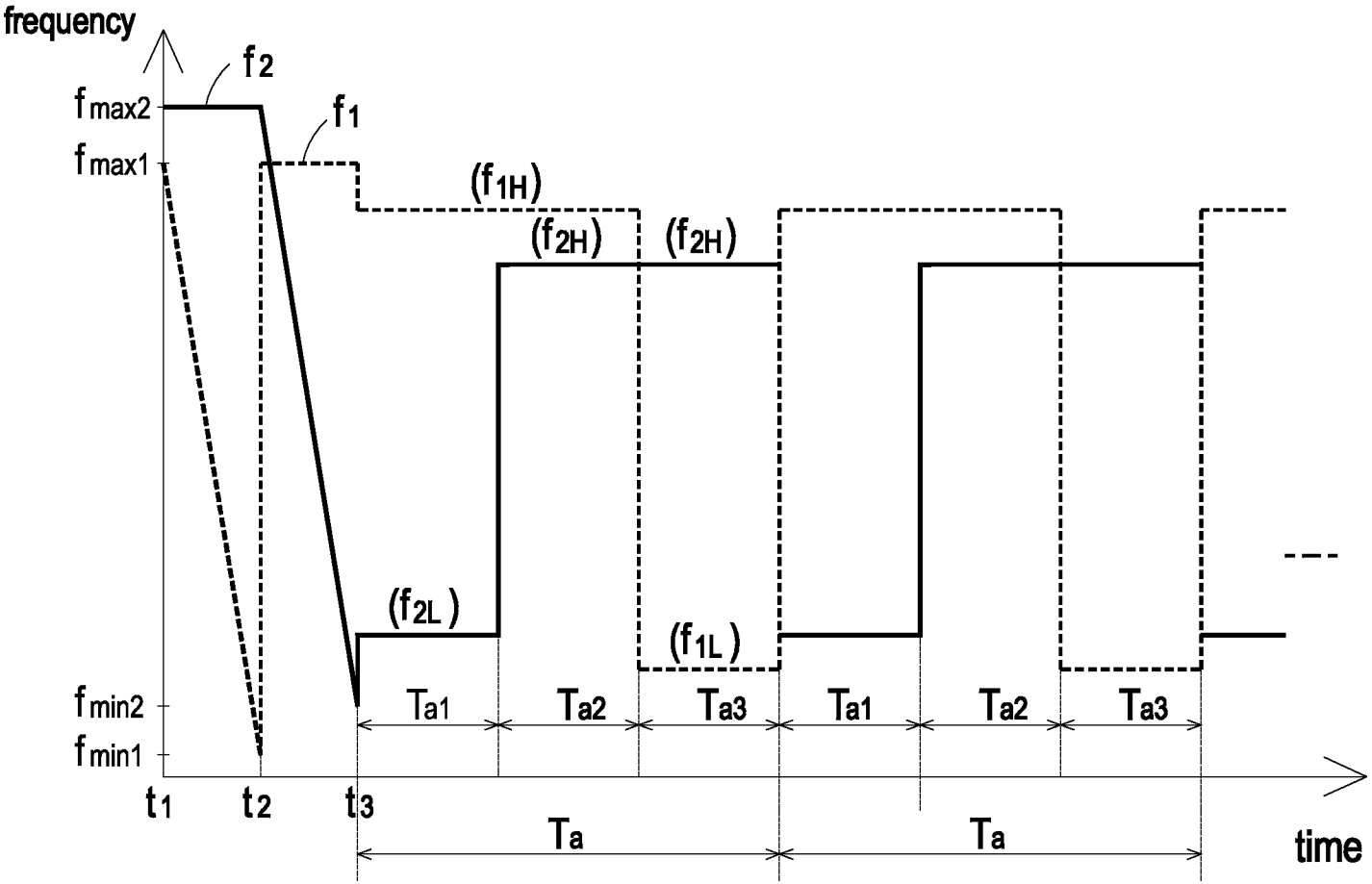
FIG. 3B is a timing waveform diagram schematically illustrating the first frequency and the second frequency processed in the heating device of FIG. 1 according to a sixth implementing example.

FIG. 3B is a timing waveform diagram schematically illustrating the first frequency and the second frequency processed in the heating device of FIG. 1 according to a sixth implementing example. The first frequency $f_1$ and the second frequency $f_2$ are respectively maintained at the high frequency value $f_{1H}$ and the low frequency value $f_{2L}$ during the first time interval $T_{a1}$; the first frequency $f_1$ and the second frequency $f_2$ are respectively maintained at the high frequency values $f_{1H}$ and $f_{2H}$ during the second time interval $T_{a2}$; and the first frequency $f_1$ and the second frequency $f_2$ are respectively maintained at the low frequency value $f_{1L}$ and the high frequency value $f_{2H}$ during the third time interval $T_{a3}$.

In this embodiment, a first average heat quantity $P_1$ offered from the first induction coil 11*a* to the first foodstuff container 2*a* and a second average heat quantity $P_2$ offered from the second induction coil 11*b* to the second foodstuff container 2*b* could be deduced according to the following formulas:

$$P_1 = P_{1L}(f_{1L}) \cdot \frac{T_{a3}}{T_a} + P_{1H}(f_{1H}) \cdot \frac{T_{a1} + T_{a2}}{T_a}$$

$$P_2 = P_{2L}(f_{2L}) \cdot \frac{T_{a1}}{T_a} + P_{2H}(f_{2H}) \cdot \frac{T_{a2} + T_{a3}}{T_a}$$

During the first time interval $T_{a1}$, the second frequency $f_2$ of the second power signal $W_2$ is adjusted to the low frequency value $f_{2L}$ according to the adjusting signal $K_1$ under control of the controlling unit 14. As such, desired heat quantity to be applied to the second foodstuff container 2*b* is adjusted. The first frequency $f_1$ is adjusted to the high frequency value $f_{1H}$ such that the difference between the high frequency value $f_{1H}$ and the low frequency value $f_{2L}$ is greater than the upper limit of human hearing range or smaller than the lower limit of human hearing range. During the third time interval $T_{a3}$, the first frequency $f_1$ of the first power signal $W_1$ is adjusted to the low frequency value $f_{1L}$ according to the adjusting signal $K_1$ under control of the controlling unit 14. As such, desired heat quantity to be applied to the first foodstuff container 2*a* is adjusted. The second frequency $f_2$ is adjusted to the high frequency value $f_{2H}$ such that the difference between the low frequency value $f_{1L}$ and the high frequency value $f_{2H}$ is greater than the upper limit of human hearing range or smaller than the lower limit of human hearing range.

Similarly, under control of the controlling unit 14, a desired first average heat quantity $P_1$ and a desired second average heat quantity $P_2$ are obtained by adjusting the first frequency $f_1$ and the second frequency $f_2$ to the low frequency value $f_{1L}$ and $f_{2L}$ during the first time interval $T_{a1}$ and the third time interval $T_{a3}$. In some embodiments, a desired first average heat quantity $P_1$ and a desired second average heat quantity $P_2$ are obtained by adjusting the first time interval $T_{a1}$, the second time interval $T_{a2}$ and the third time interval $T_{a3}$.

In some embodiments, the frequency values $f_{1H}$, $f_{2H}$, $f_{1L}$ and $f_{2L}$ are respectively maintained at the first maximum frequency value $f_{max1}$, the second maximum frequency value $f_{max2}$, the first minimum frequency value $f_{min1}$ and the second minimum frequency value $f_{min2}$ under control of the controlling unit 14. By adjusting the durations of the first time interval $T_{a1}$, the second time interval $T_{a2}$, and the third time interval $T_{a3}$, a desired heat quantity offered from the first induction coil 11*a* to the first foodstuff container 2*a* and a desired heat quantity offered from the second induction coil 11*b* to the second foodstuff container 2*b* are achieved. Since the frequency values $f_{1H}$, $f_{2H}$, $f_{1L}$ and $f_{2L}$ are respectively maintained at $f_{max1}$, $f_{max2}$, $f_{min1}$ and $f_{min2}$, after the foodstuff containers 2*a* and 2*b* reach the set temperatures, the first time interval $T_{a1}$, the second time interval $T_{a2}$ or the third time interval $T_{a3}$ could be optionally adjusted to zero according to the heat loss under control of the controlling unit 14.

In the above embodiments, the first time interval $T_{a1}$, the second time interval $T_{a2}$, the third time interval $T_{a3}$ and the fourth time interval $T_{a4}$ could be arranged at any order.

From the above description, the heating cycle of the heating device 1 includes at least a first time interval $T_{a1}$ and a second time interval $T_{a2}$. During the first time interval $T_{a1}$, the first frequency $f_1$ and the second frequency $f_2$ are both greater than the upper limit of human hearing range; and the difference between the first frequency $f_1$ and the second frequency $f_2$ is greater than the upper limit of human hearing range or smaller than the lower limit of human hearing range. As a consequence, no undesirable noise is generated. During the second time interval $T_{a2}$, the first induction coil 11*a* is disabled but the second frequency $f_2$ is maintained at a level greater than the upper limit of human hearing range. In such manner, the heat quantity or the heating temperature of the first induction coil 11*a* and the second induction coil 11*b* could be accurately controlled.

Before the heating operation is performed, the controlling unit 14 of the heating device 1 detects some heating parameters such as the first minimum frequency value $f_{min1}$, the second minimum frequency value $f_{min2}$, the first minimum power value $P_{min1}$ and the second minimum power value $P_{min2}$. Since the first time interval $T_{a1}$, the second time interval $T_{a2}$, the third time interval $T_{a3}$, the fourth time interval $T_{a4}$, the first average heat quantity $P_1$ and the second average heat quantity $P_2$ are calculated according to the heating parameters, the control signal $K_2$ could accurately reflect the desired heat quantity. In other word, the heat quantity or the heating temperature could be accurately controlled by the heating device 1 of the present invention. Since the first induction coil 11*a* and the second induction coil 11*b* are simultaneously heated during at least one time interval, the heating period will be shortened.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A heating device for heating at least one foodstuff container, said heating device comprising:

a first induction coil;

a second induction coil;

a control panel that issues an adjusting signal;

a power supply unit connected with said first induction coil and said second induction coil for providing a first power and a second power to said first induction coil and said second induction coil, respectively;

a controlling unit connected with said control panel and said power supply unit and generating a control signal to said power supply unit according to said adjusting signal, thereby controlling said first power and said second power of said power supply unit, wherein said controlling unit detects a plurality of heating parameters before a heating operation of said heating device is started, wherein said plurality of heating parameters include a first minimum frequency value, a second minimum frequency value, a first minimum power value and a second minimum power value;

wherein electrical energy is transmitted to said first induction coil and said second induction coil and the frequency difference between said first power and said second power is greater than 15 kHz or smaller than 1 kHz during a first time interval after said heating operation of said heating device is started under control of said controlling unit, and no electrical energy is transmitted to one of said first induction coil and said second induction coil during a second time interval after said heating operation of said heating device is started under control of said controlling unit;

wherein said controlling unit determines said first time interval, said second time interval and heat quantity of said at least one foodstuff container according to said first minimum frequency value, said second minimum frequency value, said first minimum power value and said second minimum power value.

2. The heating device according to claim 1 wherein said at least one foodstuff container includes a first foodstuff container and a second foodstuff container, which are heated by said first induction coil and said second induction coil, respectively.

3. The heating device according to claim 1 wherein said controlling unit is a pulse frequency modulation controller or a digital signal processor.

4. The heating device according to claim 1 wherein a first frequency of said first power and a second frequency of said second power are adjusted according to said control signal.

5. The heating device according to claim 4 wherein before said first time interval and said second time interval, said first frequency is gradually decreased from a first maximum frequency value to said first minimum frequency value under control of said controlling unit, thereby detecting said first minimum power value corresponding to said first maximum frequency value and a first maximum power value corresponding to said first minimum frequency value.

6. The heating device according to claim 5 wherein said second power is zero under control of said controlling unit before said first time interval and said second time interval.

7. The heating device according to claim 4 wherein before said first time interval and said second time interval, said second frequency is gradually decreased from a second maximum frequency value to said second minimum frequency value under control of said controlling unit, thereby detecting said second minimum power value corresponding to said second maximum frequency value and a second maximum power value corresponding to said second minimum frequency value.

8. The heating device according to claim 7 wherein said first power is zero under control of said controlling unit before said first time interval and said second time interval.

9. The heating device according to claim 4 wherein during said first time interval, the frequency difference between said first frequency and said second frequency is ranged from 15 kHz to 25kHz, and the frequency values of said first frequency and said second frequency are greater than 15 kHz.

10. The heating device according to claim 4 wherein during said second time interval, said first power is zero and the frequency value of said second frequency is greater than 15 kHz.

11. The heating device according to claim 4 further comprising a third time interval and a fourth time interval, and wherein each duration of said first time interval, said second time interval, said third time interval and said fourth time interval is adjusted by said control unit.

* * * * *